United States Patent [19]

Malone et al.

[11] Patent Number: 4,721,848

[45] Date of Patent: Jan. 26, 1988

[54] ELECTRICAL HEATER

[75] Inventors: Neil S. Malone, Flixton; Paul M. Boshell, Stockport, both of United Kingdom

[73] Assignee: Heat Trace Limited, Cheshire, United Kingdom

[21] Appl. No.: 858,442

[22] PCT Filed: Jul. 25, 1985

[86] PCT No.: PCT/GB85/00329

§ 371 Date: Mar. 20, 1986

§ 102(e) Date: Mar. 20, 1986

[87] PCT Pub. No.: WO86/01064

PCT Pub. Date: Feb. 13, 1986

[30] Foreign Application Priority Data

Aug. 1, 1984 [GB] United Kingdom ..... 8419619

[51] Int. Cl.[4] ..... H05B 3/00; H01C 7/00

[52] U.S. Cl. ..... 219/504; 219/505; 338/22 R

[58] Field of Search ..... 219/504, 505, 528, 535, 219/541, 548, 552; 338/22 R, 22 SD, 23, 25

[56] References Cited

U.S. PATENT DOCUMENTS 4,117,312 9/1978 Johnson et al. ..... 219/528 X

*Primary Examiner*—Peter S. Wong
*Assistant Examiner*—Emanuel Todd Voeltz
*Attorney, Agent, or Firm*—Spensley Horn Jubas & Lubitz

[57] ABSTRACT

A self-limiting electrical heater comprising an elongate resistance heating element and a PTC resistor. The resistor is elongate and extends side-by-side with and along the length of the heating element so as to be responsive to the temperature of the entire length of the heating element. The heating element and resistor are connected in series, the resistor having a positive temperature coefficient such that its electrical resistance is substantially less than that of the heating element when at a normal operating temperature but increases rapidly when exposed to temperatures above the normal operating temperature.

11 Claims, 10 Drawing Figures

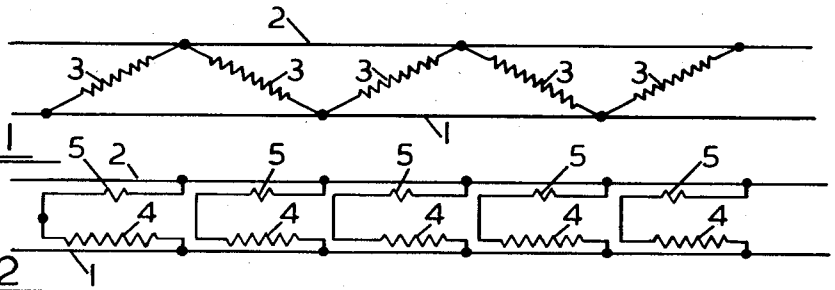
FIG. 1
PRIOR ART
FIG. 2
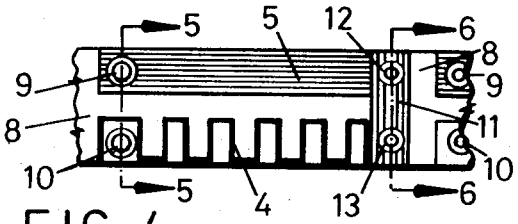
FIG. 4
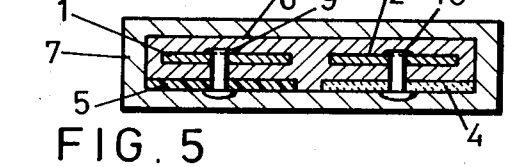
FIG. 5
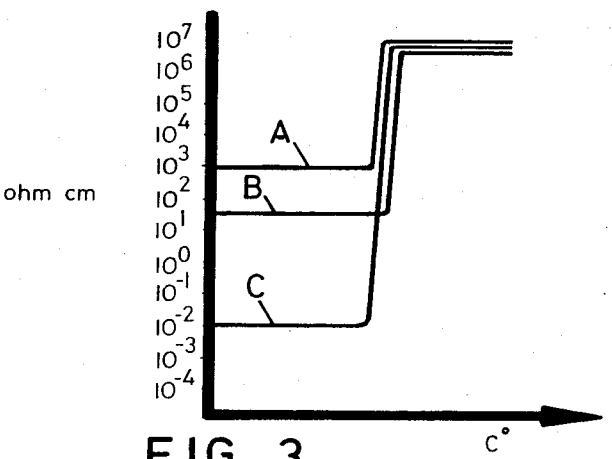
FIG. 3

ELECTRICAL HEATER

The present invention relates to an electrical heater.

Electrical heaters are used for a variety of purposes, for example to maintain the temperature of pipes in industrial plants at required levels. The heaters are usually in the form of tapes which are wrapped around the pipes to be heated and connected to an appropriate electrical supply.

Most known heating tapes comprise two or more conductors or busbars extending longitudinally of the tape and a resistance heating medium electrically connected between the busbars. Generally the tapes can be considered as falling into one of two categories, the first category being that in which the resistance heating medium is simply connected between the busbars across the width of the tape, and the second category being that in which the resistance heating medium is in discrete sections each extending a relatively short distance along the length of the tape between points at which it is connected to the busbars. There are many examples of the first category, the heating medium generally being in the form of an extruded mass in which the busbars are embedded. Such a heating tape is described in British Patent Specification No. 1521460. The extruded mass may be for example carbon-loaded polymer. An example of the second category is described in British Patent Specification No. 1523129.

Some of the heating tapes have the characteristic that as their temperature rises the electrical resistance also rises, thereby avoiding overheating in the event of a fault in the system of which the heating tape is a part. Tapes with such characteristics are known as self limiting heating tapes. Most self limiting heating tapes belong to the first category of tapes and comprise a heating medium in the form of an extruded mass of polymeric material containing a component which results in a temperature dependent resistance. The material has a positive temperature coefficient, and such materials are referred to hereinafter as PTC materials. A resistance heater incorporating such a PTC heating medium is described in British Pat. No. 1449261.

The structure of the known self limiting tapes of the first category is such that the electrical path from one busbar to the other is generally between six and twelve millimeters. This makes the dimensional accuracy and chemical composition critical to heat output. The situation is further complicated by the known phenomena that carbon-filled polymer extrudates are far less homogeneous across the direction rather than along the direction of extrusion. Consequently it is found that large variations in output can occur from point to point along the tape due to a combination of factors. This can result in either dangerous overheating and/or the waste of significant quantities of energy. An extreme example of the tolerances and degree of homogeneity required can be illustrated from one embodiment of U.S. Pat. No. 4,117,312. This heating tape has a coating of a PTC material applied to one of the busbars. The resistance of this coating should increase very sharply at a certain temperature and thus act as a thermal switch. However to be effective this switching should occur over a narrow temperature range and thus the PTC material should be almost perfectly homogeneous and the thickness of the coating should be the same along the entire length of the busbar. It would be extremely unlikely that this coating could be manufactured and applied within such strict tolerances throughout the whole tape.

The afore-mentioned problems associated with self limiting tapes of the first category have been recognized and alternative tape structures have been proposed. For example, British Patent Specification No. 2120909 describes the use of an elongate PTC strip which is spiraled around a pair of power supply conductors and electrically connected to the power conductors at spaced apart locations. Thus the structure described in British Patent Specification No. 2120909 is of the second category but the simple resistance material normally used as the heating element has been replaced by a conventional PTC material.

Electrical surface heating tapes which have a self limiting material as their heating element have a major disadvantage for their heat output can drop dramatically from a start up condition to their operating temperature. For example they could have an output of 40 watts per meter at 10° C. which could decrease to 10 watts per meter at 40° C. This is due to their resistance increasing relatively slowly within this temperature range. This means that when the system is cold, i.e. at turn on, there is a very high in-rush current. This in turn means that it is very difficult to provide over-current protection, and power supplies must be sufficient to meet current demands at turn on which are several times greater than during normal operation.

The known PTC materials are also subject to heat ageing/thermal degradation effects so that the resistance versus temperature relationship can be transformed over a prolonged period. This problem is greatly aggravated by voltage stress due to the fact that the resistance of the PTC material is continuously cycling. This is obviously a serious problem when the tapes are to remain in situ for many years and considerably reduces the commercial significance of being able to provide a self limiting characteristic.

Most of the prior art tapes are also disadvantageous as within their normal operating range the output goes down with increasing temperature whereas it is generally desirable to use tapes with a higher output at higher temperature where the heat losses are greater. A much more abrupt temperature change at the maximum possible operating temperature would be more useful.

U.S. Pat. No. 4,117,312 describes an arrangement which avoids the problems of high current in-rush at turn on but retains a self limiting characteristic. One embodiment of U.S. Pat. No. 4,117,312 is a heating tape of the second category, that is it comprises a series of heating wires each connected between two power supply conductors, but each wire is connected to the power supply conductors by a small connecting element formed from a ceramic PTC material. However this design is not really satisfactory as it does not permit the detection of individual hot spots at all possible places along the whole of the tape. If the number of spot detectors were increased in an attempt to alleviate the problem the manufacture would be very difficult.

A considerable research effort has been devoted to developing improved heating devices often making use of PTC materials as indicated by articles in the literature by J. Meyer (Polymer Engineering and Science Nov. 1973, 462–468) and F. Bueche (J. of Applied Physics vol. 44 No. 1 Jan. 1973, 532–533) and published PCT Application No. 84/02048, U.S. Pat. Nos. 4,426,339, 4,352,083, 4,329,726, 4,317,027, 3,976,600, 3,760,495, 3,591,526, 3,243,753 and British Patent Specification Nos. 2144132, 2132426, 2129814, 2124635, 2096393, 2075992, 2074585, 2074377, 2074376, 2074375, 2036784, 2033707, 1605005, 1604735, 1595198, 1561355, 1449262 and 1449261. The above-mentioned documents also include cross-references to many other prior art documents. In most of the applications for PTC materials a relatively high resistivity has been required in that the PTC material has been used as a heating element, and accordingly the resistivities of the known PTC materials are generally relatively high, for example 1000 ohm cm or greater. Considerably lower resistivities are known in PTC materials however and the techniques required to produce the desired resistivity are also known. By way of example the afore-mentioned British Patent Specification No. 2074585 refers to a PTC material having a resistivity of less than 50 ohm cm.

It is an object of the present invention to provide an improved electrical heater incorporating PTC material to provide a self limiting effect which heater obviates or mitigates the various problems described above.

According to the present invention, there is provided an electrical heater comprising at least one elongate resistance heating element, an elongate resistor extending along said at least one heating element, the resistor being connected in series with said at least one heating element, and means for connecting said at least one heating element and said resistor in series across an electrical power source, the resistor having a positive temperature coefficient such that its electrical resistance is substantially less than that of the heating element when the temperature of the resistor does not substantially exceed a predetermined temperature equal to the temperature at which the electrical heater is intended to operate, and such that its electrical resistance increases substantially when the resistor temperature substantially exceeds the said predetermined temperature.

Thus in accordance with the present invention by selecting a relatively low resistivity for the PTC material it is possible to provide an electrical heater incorporating the best features of conventional non-self limiting heaters and conventional self limiting heaters.

The resistor may be in any convenient form, for example an extruded or moulded PTC polymer. A PTC conductive coating could be supported on a suitable substrate, or an elongate ceramic PTC material could be used. The heating element may also be in any convenient form, for example a resistance heating wire or a polymer composite. The electrical heater may incorporate two longitudinal power conductors extending along its length, appropriate connections being made between one end of the resistor and one conductor and one end of the heating element and the other power conductor.

The PTC resistor acts effectively as a switch which opens to isolate the associated heating element from the power supply whenever overheating is detected but the effect of which is reversible so that once the causes of the overheating have been removed the associated heating element can again operate normally.

In normal operating conditions the output of the heater in accordance with the invention is substantially constant given a constant supply voltage. Thus the problems associated with most self limiting heating tapes of high in-rush of current at turn on is avoided. The problem of heat ageing and thermal degradation is also mitigated to a degree dependent upon the material selected for the PTC resistor as it can be arranged for the resistance to change very rapidly over a narrow band at a high temperature which will only be reached in abnormal conditions. Furthermore very secure mechanical connections can be made between the various components of the heater so as to reduce the risk of loss of electrical contact between the various components.

Embodiments of the present invention will now be described, by way of example, with reference to the accompanying drawings, in which:

FIG. 1 illustrates the electrical circuit of a prior art heating tape of the type described in British Patent Specification No. 1523129;

FIG. 2 illustrates the electrical circuit of an embodiment of the present invention;

FIG. 3 illustrates the relationship between resistivity and temperature for a PTC material of the type used in known self limiting heating tapes and for PTC materials having characteristics suitable for use in an embodiment of the present invention;

FIG. 4 is a schematic cut-away plan view of a first embodiment of the invention;

Figure 7:
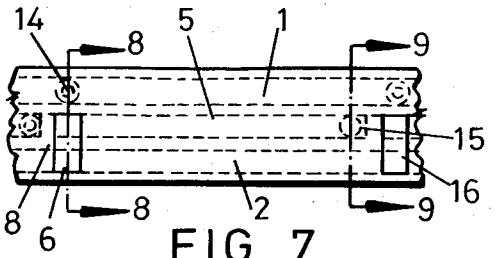
Figure 8:
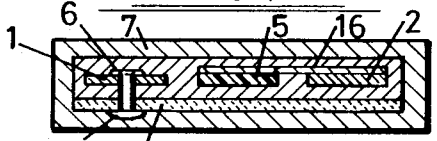
Figure 9:
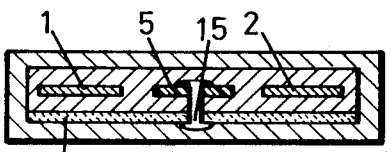
Figure 6:
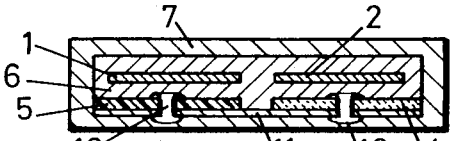
Figure 10:
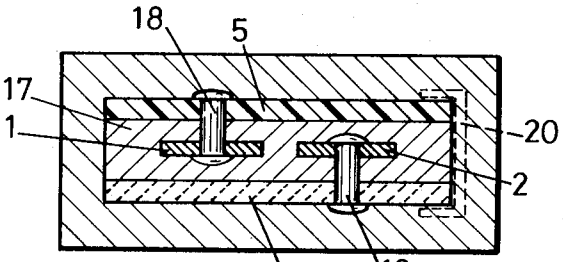

FIGS. 5 and 6 show sections through the embodiment of FIG. 4 on lines 5—5 and 6—6 respectively;

FIG. 7 is a schematic cut-away plan view of a second embodiment of the present invention;

FIGS. 8 and 9 show sections through the embodiment of FIG. 7 on lines 8—8 and 9—9 respectively; and FIG. 10 is a cross-section through a third embodiment of the present invention.

Referring to the drawings, FIG. 1 shows the electrical circuit of a prior art device in which two conductors 1, 2 extend longitudinally of a heating tape. The tape is divided into a series of identical heating elements each comprising a resistance wire 3 which may be woven into a tape incorporated into the heating tape. Thus the heating tape comprises a series of discrete heating elements spaced apart along the length of the heating tape, the length of each heating element being a function of the required heat output of the heating tape and typically being of the order of 50 cm.

Referring now to FIG. 2, the circuit of an embodiment of the invention is illustrated. In the illustrated arrangement there is again a series of spaced apart wire heating elements 4 of equivalent dimension to the heating elements of FIG. 1 but each of these heating elements 4 is connected in series with a PTC resistor 5. The resistance of the resistor 5 is such that at normal operating temperatures most of the voltage applied between conductors 1 and 2 is applied to the wire 4. Once the resistor 5 reaches a predetermined temperature however its resistance increases rapidly effectively turning off the wire 4 with which it is connected in series. Thus localized overheating of a tape results in the heat output of the heating element in that area being reduced rapidly. The operation of the other heating elements is not significantly affected.

Referring to FIG. 3, the curve A illustrates the relationship between resistivity and temperature for a typical PTC material such as used in prior art self limiting heating tapes, for example the tape of PCT Application No. 84/02048. In such an application a relatively high resistivity is required given that the distance through the PTC material between the two supply conductors is relatively small. In contrast in embodiments of the present invention a relationship between resistivity and temperature as illustrated by for example curve B or curve C is required so that at normal operating temperatures the resistance of the PTC material is small compared with the resistance of the wire with which it is connected in series. It will of course be appreciated that adjustments to the resistance of the PTC material can be achieved by adjustment to the length and cross sectional area of the PTC material as well as by adjustments to its resistivity.

Referring now to FIGS. 4 to 6, the illustrated embodiment of the invention comprises the components 1 to 5 of FIG. 2 supported on an inner polymer body 6 encased in a polymer sheath 7. As shown in FIG. 4 a heating element 4 corresponding to the wire 4 of FIG. 2 and a PTC resistor 5 are arranged alongside each other and separated from the equivalent components of the next heating element by a short "dead" section 8. The conductors 1 and 2 do of course extend across this dead section but these conductors are omitted from FIG. 4.

One end of the resistor 5 is connected by a rivet 9 to the conductor 1 and one end of the element 4 is connected by a rivet 10 to the conductor 2 as shown in FIG. 5. The other ends of the element 4 and resistor 5 are connected together by a conductive strip 11 and rivets 12 and 13 as shown in FIG. 6. Thus the electrical circuit extends from conductor 1 via rivet 9 to resistor 5, from resistor 5 via rivet 12, strip 11 and rivet 13 to the element 4, and from the element 4 to the conductor 2 via rivet 10.

The embodiment of FIGS. 4 to 6 may be assembled in any convenient manner but preferably by using carrier strips not shown in the drawings. For example the element 4 may comprise a wire incorporated in a woven strip, and the resistor may be in the form of an extruded strip of PTC polymer material. A series of strips 11 may be positioned at the appropriate spacing along a foil carrier strip (not shown) and the element 4 and resistor 5 may then be placed over the strip 11 on the carrier foil in the appropriate location. The rivets 12 and 13 may then be inserted and the resultant structure may then be covered by a polymer strip corresponding to the portion of the polymer body 6 located between the conductors 1, 2 and the components 4, 5. The conductors 1, 2 can then be laid thereover and the rivets 9 and 10 inserted. A further polymer strip corresponding to the upper portion of the polymer body 6 may then be laid thereover and the whole assembly subsequently encased in the moulded sheath 7. Thus the embodiment may be relatively easily assembled using conventional automatic assembly techniques.

Turning now to the embodiment illustrated in FIGS. 7 to 9, equivalent components to those shown in FIGS. 4 to 6 carry the same reference numerals. Referring to FIG. 7, the position of the conductors 1 and 2 is illustrated with the resistor 5 located therebetween. As shown in FIGS. 8 and 9 the heating element 4 comprises a resistance wire incorporated in a woven strip which extends across the width of the tape beneath the conductors 1, 2 and the resistor 5.

One end of the element 4 is connected by a rivet 14 to the conductor 1 the other end of the element 4 is connected to one end of the resistor 5 by a rivet 15. The other end of the resistor 5 is connected to the conductor 2 by a conductive strip 16 that is secured by ultrasonic welding for example to the resistor 5 and the conductor 2. Thus each heating circuit extends from conductor 1 via rivet 14 to the element 4, from element 4 via rivet 15 to resistor 5, and from resistor 5 via strip 16 to the conductor 2.

Similar assembly techniques can be used for the embodiment of FIGS. 7 to 9 as are described above with regard to the embodiment of FIGS. 4 to 6.

FIG. 10 is a cross-section through another embodiment of the invention in which the conductors 1 and 2 are supported in an insulating strip 17 sandwiched between heating element 4 and resistor 5. Rivets 18 and 19 connect the heating element 4 to conductor 2 and the resistor 5 to the conductor 1. The rivets 18 and 19 are located adjacent each other at one end of the heating element. The other ends of the heating element and resistor are electrically connected by a conductive strip 20 shown in dotted lines. The assembly is then encased in a sheath.

It will be appreciated that alternative structures to those illustrated in the accompanying drawings could be provided. The illustrated arrangement incorporating rivet connections is particularly robust and reliable but acceptable products may be produced by alternative methods, for example by simply overlying the various components with appropriate electrically insulating and electrically conducting spaces between them.

Illustrated embodiments of the invention all comprise heating tapes in which a plurality of heating elements are spaced apart along the length of the tape. It would however be possible to provide a heater in accordance with the present invention fabricated from a single heating element and a single PTC resistor. For example a small electric heater for a domestic appliance could be fabricated in such a manner.

We claim:

1. An electrical heater comprising first and second power conductors, at least one elongate resistance heating element, an elongate resistor extending side by side with and along the full length of said at least one heating element, a first end of said resistor being connected to a first end of said at least one heating element, a second end of said resistor being connected to said first power conductor, and a second end of said at least one heating element being connected to said second power conductor, wherein the resistor has a positive temperature coefficient such that its electrical resistance is substantially less than that of the heating element when the temperature of the resistor does not substantially exceed a predetermined temperature equal to the temperature at which the electrical heater is intended to operate, and such that its electrical resistance increases substantially when the resistor temperature substantially exceeds the said predetermined termperature.

2. An electrical heater according to claim 1, wherein the resistor is in the form of an extruded PTC polymer.

3. An electrical heater according to claim 1, wherein the heating element is in the form of a resistance wire.

4. An electrical heater according to any preceding claim, wherein two power conductors are incorporated into the electric heater extending parallel to the heating element and the resistor.

5. An electrical heater according to claim 4, wherein the heating element and the resistor are in the form of flat strips located side by side and each power conductor is in the form of a flat strip located one above the resistor and one above the heating element.

6. An electrical heater according to claim 4, wherein the heating element, resistor and power conductors are in the form of flat strips, the power conductors and the resistor being located side by side over the heating element.

7. An electrical heater according to claim 4, wherein the conductors are in the form of flat strips supported in an insulating strip and the heating element and resistor are supported on opposite sides of the strip.

8. An electrical heater comprising first and second power conductors, an elongated resistance heating element and an elongated resistor, said elongated resistor having a positive temperature coefficient such that its electrical resistance is substantially less than that of the elongated resistance heating element when the temperature of the elongated resistor does not substantially exceed a predetermined temperature and such that the electrical resistance of the elongated resistor increases significantly when the temperature of the resistor exceeds said predetermined temperature, said elongated resistance heating element and elongated resistor being connected in series across the first and second power conductors such that an electric current flows substantially parallel to the longitudinal axes of the elongated resistor and the elongated resistance heating element and further being arranged such that substantially all points on the longitudinal axis of the elongated heating element are substantially equidistant from the longitudinal axis of the elongated resistor.

9. The electrical heater of claim 8 wherein the elongated resistor comprises an extruded PTC polymer.

10. The electrical heater of claim 8 wherein the heating element is in the form of a resistance wire.

11. The electrical heater of claim 1 wherein an electric current flows substantially parallel to the longitudinal axis of the elongate resistor and the elongated resistance heating element.

* * * * *